US008302244B2

(12) United States Patent
Hatch et al.

(10) Patent No.: US 8,302,244 B2
(45) **Date of Patent: *Nov. 6, 2012**

(54) DISPOSABLE HYGIENIC TOILET BOWL CLEANER WITH WAND

(76) Inventors: Thomas Clyde Hatch, Lexington, KY (US); Matthew Stewart Hatch, Lexington, KY (US)

( * ) Notice: Subject to any disclaimer, the term of this patent is extended or adjusted under 35 U.S.C. 154(b) by 1354 days.

This patent is subject to a terminal disclaimer.

(21) Appl. No.: 12/004,930

(22) Filed: Dec. 21, 2007

(65) Prior Publication Data

US 2009/0163126 A1 Jun. 25, 2009

Related U.S. Application Data

(63) Continuation-in-part of application No. 11/588,675, filed on Oct. 27, 2006.

(51) Int. Cl.
*A47L 13/10* (2006.01)
*E03D 9/00* (2006.01)

(52) U.S. Cl. ..... 15/104.94; 15/104.001; 15/210.1

(58) Field of Classification Search ..... 15/104.94, 15/210.1, 227, 104.001
See application file for complete search history.

(56) References Cited

U.S. PATENT DOCUMENTS

| | | | | |
|---|---|---|---|---|
| 2,572,178 | A | 10/1951 | Monroe | |
| 2,648,085 | A | 8/1953 | Rodgers | |
| 2,755,497 | A | 7/1956 | Greacen | |
| 2,919,455 | A | 1/1960 | Turner | |
| 3,753,267 | A | 8/1973 | Johnson, Sr. | |
| 4,031,673 | A | 6/1977 | Hagelberg | |
| 4,493,124 | A | 1/1985 | Agapiou | |
| 4,788,733 | A * | 12/1988 | Lerner | 15/104.94 |
| 4,852,201 | A | 8/1989 | Wundrock | |
| 4,902,283 | A | 2/1990 | Rojko | |
| 4,932,095 | A * | 6/1990 | Kawase | 15/227 |
| 4,937,881 | A * | 7/1990 | Heise | 2/16 |
| 4,964,188 | A * | 10/1990 | Olson | 15/227 |
| 4,974,730 | A * | 12/1990 | Deruysscher | 206/581 |
| 5,092,013 | A * | 3/1992 | Genovese, Jr. | 15/104.94 |
| 5,134,746 | A * | 8/1992 | William | 15/227 |
| 5,488,748 | A | 2/1996 | Koch | |
| 5,592,713 | A * | 1/1997 | Rones | 15/210.1 |
| 5,630,243 | A | 5/1997 | Federico | |
| 6,047,435 | A * | 4/2000 | Suzuki et al. | 15/229.8 |
| 6,250,829 | B1 * | 6/2001 | Brower et al. | 401/7 |
| 6,295,688 | B1 | 10/2001 | Sayles | |
| 6,463,620 | B2 | 10/2002 | Busha | |
| 6,689,224 | B1 * | 2/2004 | Hillman | 134/6 |
| 6,842,935 | B2 | 1/2005 | Peterson | |
| 7,065,825 | B2 | 6/2006 | Minkler | |
| 7,127,768 | B2 | 10/2006 | Blum | |
| 2004/0244130 | A1 * | 12/2004 | Kim | 15/104.94 |

* cited by examiner

*Primary Examiner* — Randall Chin

(74) *Attorney, Agent, or Firm* — Pearl Cohen Zedek Latzer, LLP

(57) ABSTRACT

Embodiments of the present invention are directed to devices and methods for cleaning, disinfecting, or sanitizing a toilet bowl surface or other surface. The device features a sheath having a first surface and second surface. The sheath is capable of assuming two positions. In said first position the first surface faces inward toward itself defining a first opening and a first chamber. In the second position the second surface faces inward towards itself defining a second opening and a second chamber and the first surface faces outward. The sheath is moved from the first position into the second position by inverting it over a flexible head attached to a hollow wand. A roughening agent is affixed to the first surface for cleaning toilet bowl surfaces and other surfaces. A cleaning, disinfecting or sanitizing agent can also be applied to the first surface of the sheath.

11 Claims, 4 Drawing Sheets

DISPOSABLE HYGIENIC TOILET BOWL CLEANER WITH WAND

CROSS-REFERENCE TO RELATED APPLICATIONS

This application is a continuation-in-part and claims priority to U.S. Ser. No. 11/588,675 filed Oct. 27, 2006, pending.

STATEMENT REGARDING FEDERAL SPONSORSHIP

The present invention was not made or developed with Federal sponsorship.

BACKGROUND OF THE INVENTION

This invention relates to a disposable sheath that is inverted over a multi-use flexible head attached to a wand, to be used to clean toilet bowls and other surfaces.

DESCRIPTION OF PRIOR ART

Cleaning a toilet bowl is one of the most undesirable household chores for most people. This is because toilets are contaminated by various organic materials that contain or support growth of microorganisms. Toilet bowls must be kept clean to prevent harmful bacteria buildup, irritable smells and potentially unsanitary conditions.

Toilets are most commonly cleaned with brushes that have bristles permanently affixed to a handle. While effective in their primary task of cleaning toilet bowls, such brushes have serious drawbacks related to their storage between uses. Regardless of how much care is taken to clean the bristles following use, there often remain small quantities of feces, urine and stray bits of paper typically found in a toilet. These can cause brushes to develop an unpleasant odor and make the brushes undesirable for storage in proximity to the toilet.

It is common for a user to attempt to clean off a bristle brush following use by swirling it repeatedly in the bowl water. In some cases, this rinsing process will be repeated through several rinsing flushes. The delay in waiting for the cistern to refill is such as to discourage most users from rinsing a reusable brush more than once or twice. In any case, valuable time and water is wasted through this effort to thoroughly clean a brush after use.

Numerous types of disposable cleaning elements have been developed in response to consumer's desires to avoid storing unsanitary bristle brushes. Illustrative are the apparatus discussed in U.S. Pat. Nos. 4,852,201 and 7,127,768 B2.

In the '201 patent, a toilet bowl cleaner is disclosed having a handle with a removable cleaning pad disposed on one end. While preferable to a bristle brush, this toilet bowl cleaner illustrates several of the shortcomings of current disposable pads and apparatuses. First, the pad is substantially rigid and thus cannot conform to the various curvatures of a toilet bowl. Second, the pad release mechanism requires a user to directly contact the used pad to remove and replace the pad. This latter characteristic does little to reduce the unpleasant nature of cleaning a toilet. Finally, following removal from the handle, the soiled disposable pad is typically placed in a waste basket where malodorous contaminants on its surface can still foul the air.

U.S. Pat. No. 7,127,768 describes a disposable cleaning head comprising a sponge, scrim and a flexible fitment that engages a handle. The sponge portion of the head allows it to conform to the curvature of the toilet bowl. It can also be removed from the handle without the pad being touched by the user. However, this pad element and other similar disposable pad elements must still be placed in a wastebasket for disposal where they can give off unpleasant odors. Another drawback of this and other disposable pads is the potential dripping of water on the bathroom floor while the disposable head is being moved from the toilet bowl to the waste basket. In addition, this pad element is representative of most disposable pad elements that are bulky to ship and expensive to manufacture. The high cost of using such disposable toilet bowl pads limits their use to higher income households or requires that the interval between uses is increased to counterbalance their high cost.

OBJECTS AND ADVANTAGES

Accordingly, several objects and advantages of the present invention are:

(a) to provide a disposable sheath with a scrim-like roughened surface that can be placed onto a separate multi-use head and wand;

(b) to avoid the materiel cost of providing a supporting head with each disposable element used to clean a toilet bowl;

(c) to reduce the cost of shipping disposable toilet bowl elements by providing a disposable sheath that is lightweight and compact;

(d) to provide a flexible head and wand separate from the disposable sheaths;

(e) to provide a means of placing the disposable sheath on the multi-use head and handle with a minimum of effort or time;

(f) to provide for a means of disposing of the soiled, scrim-like surface of the disposable sheath in a closed chamber that prevents the escape of any associated odors;

(g) to provide a means of storing multiple disposable sheaths in a cartridge on or adjacent to the toilet bowl before use that is aesthetically pleasing and that eliminates the need for the user to search elsewhere such as under the bathroom sink for something to clean the toilet;

(h) to provide a means of removing the disposable sheath from the multi-use head and wand without having to touch any surfaces that come into contact with the toilet bowl itself or the water in the toilet bowl;

(i) to provide a pre-determined amount of a cleaning or disinfecting chemical on the roughened, scrim-like surface of the disposable sheath that can complement the mechanical action provided by the sheath, head and wand during the cleaning operation; and (j) to prevent toilet bowl water from dripping onto the bathroom floor as the disposable element is removed from the toilet bowl and deposited in the waste basket.

Further objects and advantages of our invention will become apparent from a consideration of the drawings and ensuing description.

SUMMARY OF THE INVENTION

In accordance with the above objects and those that will be mentioned and will become apparent below, the invention comprises a disposable sheath with a first surface and a second surface, and a hollow wand and head over which the sheath can be drawn. In the first position, surface one of the sheath faces inward, either for storage prior to use or for touch-free disposal following use. A cleaning surface comprised of a roughening agent similar to scrims on prior art devices is attached to a portion of the first surface. In the second position, the scrim-like roughening agent on the first surface faces outward. The disposable sheath is placed into each of the two positions by means of moving the sheath over the specially designed flexible head that is attached to a hollow wand. The sheath is inverted as it moves from the first position within the head and the handle to the second position where surface one faces outward. Surface two of the sheath, which is opposite the scrim-like roughened portion of surface one encases the head. The multi-use flexible head provides structural support to the single use disposable sheaths. Separation of the head and the sheath to which the roughening agent is attached is one of the novel and surprising elements of this invention.

After being used to clean a toilet bowl, the disposable sheath is turned outside in, moving from position two on the outside of the head and wand to position one on the inside of the head and wand, where it can then be disposed of in a sanitary fashion. Providing a head that can be used repeatedly with multiple disposable sheaths reduces both the materiel cost and cost of shipping bulky heads in prior art devices. The same storage space in the confined space of a bathroom can be used to store many more disposable sheaths than would be possible if each disposable unit included the structural support provided by the head.

In the preferred embodiment, a tether element is attached to the closed end of the disposable sheath. After the roughening agent attached to the first surface has been moved into position two and used to clean the soiled surface of the toilet bowl, the tether element that remained inside the head and wand can be pulled out and away from the end of the wand opposite the head, which action returns the sheath to the first position facing inward, making it easy to discard. Returning the soiled roughening agent on the first surface back to the first position without the user having to touch the soiled first surface leads to easy disposal of the sheath and is one of the many novel aspects of this invention. In addition, after the sheath is returned to the first position, a knot can be tied in the end of the sheath, sealing all the odors that may emanate from the cleaning surface inside the sheath that is subsequently placed in the waste basket.

In the preferred embodiment lengthwise folds are placed in sheaths to minimize the space occupied by each sheath in a storage tube and to facilitate placement on the flexible head and wand.

In the preferred embodiment the area of the sheath covered by the roughening agent can also be coated with a cleaning agent. The cleaning agent or composition can optionally include one or more bactericidal agents, bleaching agents, chelants, salts, coloring agents, fragrances and preservatives. When the sheath is moved into position two and the sheath-covered head is lowered into the toilet bowl, this cleaning composition can be mixed with the toilet water or applied directly onto the toilet bowl surface.

In the preferred embodiment a semi-flexible head formed of polyurethane foam and the wand are configured to facilitate the easy placement of the disposable sheath into position two. Preferably the head and hollow wand are placed over and are partially supported by a vertical storage tube containing one or more disposable sheaths. The sheaths are preferably attached to each other so that as one sheath is inverted or turned inside out onto the head and wand, the next sheath is pulled upward from the storage tube and placed in position for subsequent use. The storage tube is preferably attached to a base which holds it in a vertical position. The head, wand, storage tube with enclosed sheaths and base can be stored on either the floor next to the toilet or on the lid of the toilet cistern.

BRIEF DESCRIPTION OF THE SEVERAL VIEWS OF THE DRAWINGS

While the specification concludes with claims particularly pointing out and distinctly claiming the invention, it is believed that the present invention will be better understood from the following description taken in conjunction with the accompanying drawings in which:

DETAILED DESCRIPTION OF THE PREFERRED EMBODIMENT

It is to be understood that both the foregoing general description and the following detailed description are exemplary and explanatory only and are not restrictive of the invention as claimed. The present invention provides a disposable sheath drawn over the flexible head and wand of an implement and is used to clean a toilet bowl. It is recognized by those skilled in the art that a broad range of designs may be practiced in accordance with the presently disclosed invention. It is thus to be understood that although the invention is described in connection with the cleaning of a toilet bowl, the invention can also be readily employed to clean or disinfect a variety of surfaces, such as the walls of a shower, a countertop or bench top, windows, vehicle surfaces or a sink.

Figure 1:
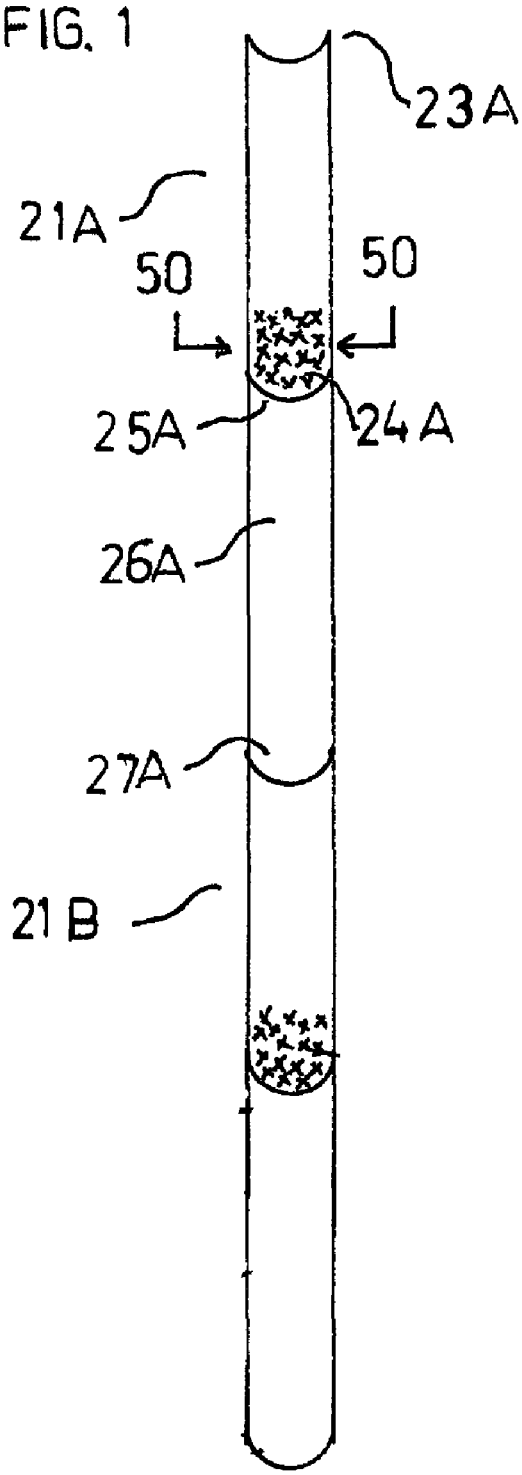
FIG. 1 is a perspective view of two invertible sheaths with attached tethers.

FIG. 1 shows a perspective view of disposable sheaths 21A and 21B in position one with a first surface facing inward forming a first chamber and second surface facing outward.

Sheaths 21A and 21B are made of plastic, foil, polyfoil or other pliable material. Open end 23A and closed end 25A form the two ends of the first chamber of sheath 21A. Roughening agent 24A made from short strands of string or twine or other particles is attached to the first surface of sheath 21A by adhesive, heat seal or other attachment means to form a scrim-like surface. A seal at closed end 25A closes the end of the first chamber where it is attached to tether 26A. End 23A of disposable sheath 21A is open and ready to be inverted over flexible head 32. When sheath 21A is turned inside out, moving from position one where the first surface faces inward to position two, first surface one with the roughening agent 24A attached will face out and envelop flexible head 32 which provides structural support for cleaning activities. Sheath 21A is connected to tether 26A at seal closed end 25A. End 27A of tether 26A is situated opposite the end of tether 26A attached to sheath 21A.

Figure 2:
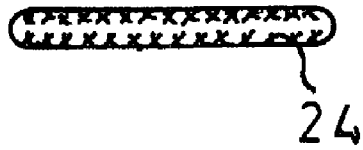
FIG. 2 is a cross-sectional end view taken at line 50 of the sheath shown in FIG. 1 with roughening agent on surface one.

FIG. 2 is a cross-sectional view at line 50 of disposable sheath 21A. Roughening agent 24 is attached to the first surface of the sheath.

Figure 3:
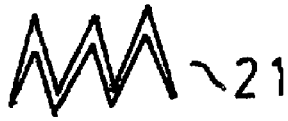
FIG. 3 is an end view of invertible sheath partially folded to reduce it width.
Figure 4:
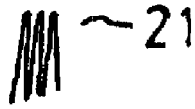
FIG. 4 is an end view of a tightly folded disposable sheath.

FIG. 3 is an end view of sheath 21 being folded to reduce its width. FIG. 4 is the same end view with folds made more tightly.

Figure 5:
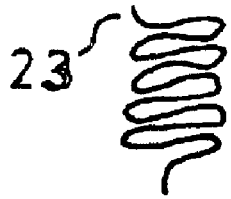
FIG. 5 is a top view of the folded disposable sheath in FIG. 4 that is subsequently folded for placement in a storage tube.

FIG. 5 is a top view of a sheath 21 folded to facilitate placement in a storage tube.

Figure 6:
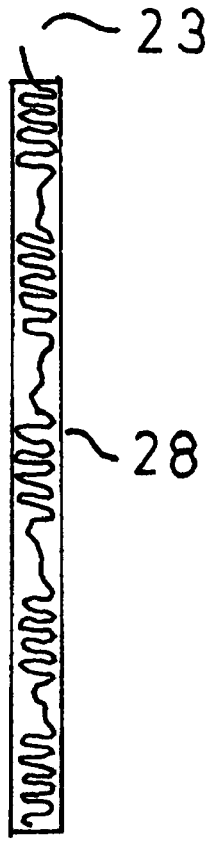
FIG. 6 is a cross sectional view of a storage tube loaded with multiple serially-connected disposable sheaths and tethers.

Multiple sheaths 21 stored in storage tube 28 are shown in FIG. 6. Open end 23 is shown at the top, ready to be moved from position one to position two over the flexible head 32. Storage tube 28 is preferably made from cardboard but can be made from plastic or any other substance that provides the needed wall rigidity.

Figure 7:
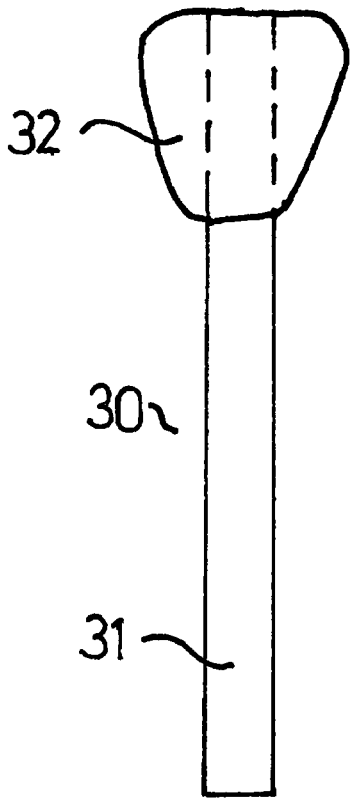
FIG. 7 is a front view of the wand and flexible head of the toilet cleaning implement.

Implement 30 shown in FIG. 7 comprises a flexible head 32 and hollow wand 31. Flexible head 32 is preferably manufactured from flexible polyurethane foam that can mold itself to the contour of the inside of a toilet bowl or other surface during the cleaning operation. Wand 31, including the portion that is inside flexible head 32 is approximately 15 inches in length. Wand 31 is a hollow tube, preferably made of polyvinyl chloride and preferably ¾ inch to 1¼ inch in diameter. Head 32 as shown is approximately three inches across and three high.

Figure 8:
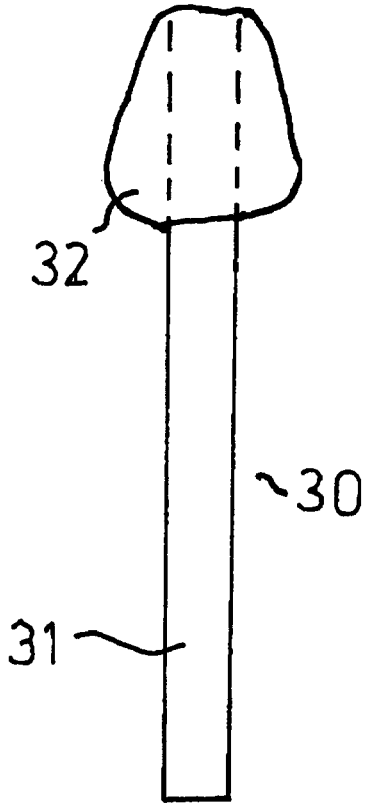
FIG. 8 is a side view of the wand and flexible head of the toilet cleaning implement.

FIG. 8 shows a side view of implement 30, comprising the hollow wand 31 and flexible head 32.

Figure 9:
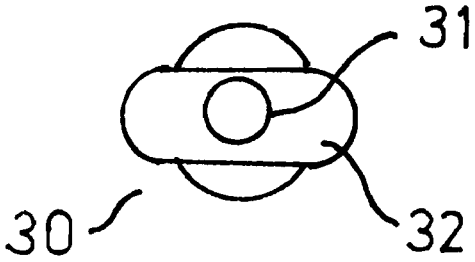
FIG. 9 is a top view of the wand and flexible head of the toilet cleaning implement.

A top view of wand 31 centered in flexible head 32 is shown in FIG. 9.

Figure 10:
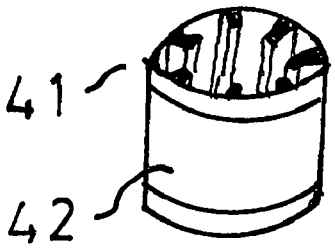
FIG. 10 is a perspective view of a retaining ring covered with adhesive tape.

FIG. 10 is a perspective view of retaining ring 41. After sheath 21 is inverted over flexible head 32, sheath 21 is attached to the adhesive surface 42 of retaining ring 41. Retaining ring 41 fits tightly around wand 31 by means of a friction fit between the inside ribs of retaining ring 41 and the outside wall of wand 31. Disposable sheath 21 is tightened around wand handle 31 as retaining ring 41 is twisted. This prevents excess sheeting from sheath 21 from interfering with the toilet cleaning operation.

Figure 11:
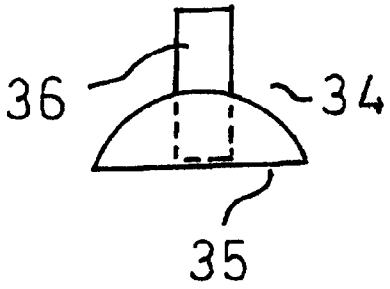
FIG. 11 is a front view of a base stand that is used to support the storage tube from FIG. 6 in an upright position.

FIG. 11 shows a front view of base 34, comprising a flat bottom 35 that rests on the floor, the counter top or on the lid to the toilet cistern, and support tube 36, into which storage tube 28 can be placed.

Figure 12:
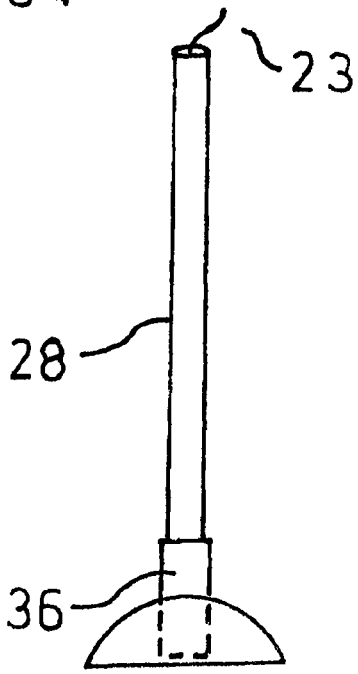
FIG. 12 is a front view of the base stand of FIG. 11 loaded with the storage tube from FIG. 6, with an end of a disposable sheath extending from the end of the storage tube.

FIG. 12 is a front view of storage tube 28 loaded into support tube 36 of FIG. 11, with open end 23 of sheath 21 extending from the top.

Figure 13:
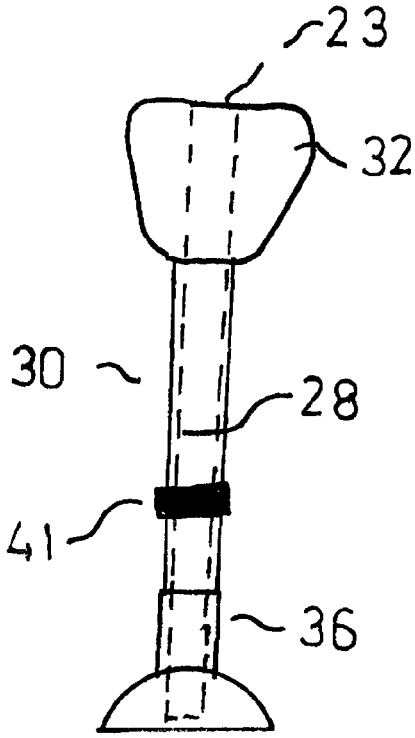
FIG. 13 is a front view of a wand with flexible head of FIG. 7 positioned down over the storage tube in the base from FIG. 12.

FIG. 13 is a front view of implement 30 placed over storage tube 28, with storage tube 28 positioned in support tube 36 of base 34. Open end 23 of sheath 21 extends out of the end of storage tube 28 which is contained in hollow wand 31, ready to be inverted over flexible head 32 of implement 30 as it is moved from position one to position two. Multiple sheaths 21 are folded in storage tube 28, each attached end to end with a perforated tear zone between.

Figure 14:
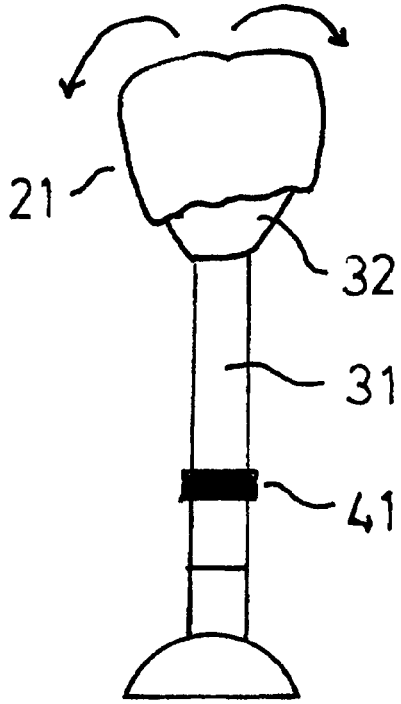
FIG. 14 is a front view of the invertible disposable sheath as it is pulled up and out of the storage tube and hollow wand and partway down around the flexible head of the toilet cleaning implement.

FIG. 14 is a perspective view of sheath 21 being inverted over flexible head 32 of implement 30 as it moves from position one to position two. The inside circumference of sheath 21 is slightly larger than the outside circumference of flexible head 32. As sheath 21 is drawn out and down over flexible head 32, the remainder of sheath 21 is drawn up and out of storage tube 28.

Figure 15:
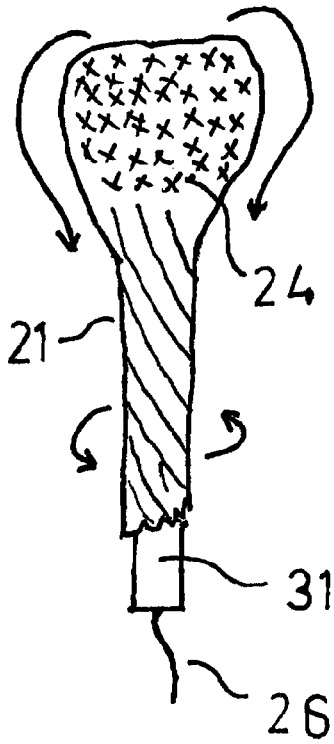
FIG. 15 is a front view of the invertible disposable sheath as it is pulled all the way down over the flexible head and wand of the toilet cleaning device, attached to the adhesive surface of the retaining ring of FIG. 10 and twisted.

FIG. 15 is a perspective view of sheath 21 in position two, fully inverted over implement 30. Retaining ring 41 with sheath 21 attached has been twisted around wand 31, tightening sheath 21 around wand 31. Roughening agent 24 on surface one of sheath 21 is situated over flexible head 32. Flexible head 32 provides structural support to sheath 21 in position two. Sheath 21 completely isolates flexible head 32 and wand 31 from the water or surfaces of the toilet bowl. After sheath 21 is moved into position two on implement 30, the roughening agent 24 on disposable sheath 21 envelop the flexible head, allowing implement 30 to be scrubbed against the curved walls of the toilet bowl, with the compressibility of the polyurethane foam allowing sheath 21 and flexible head 32 to take the shape of the curves in the toilet bowl as the cleaning operation proceeds.

Figure 16:
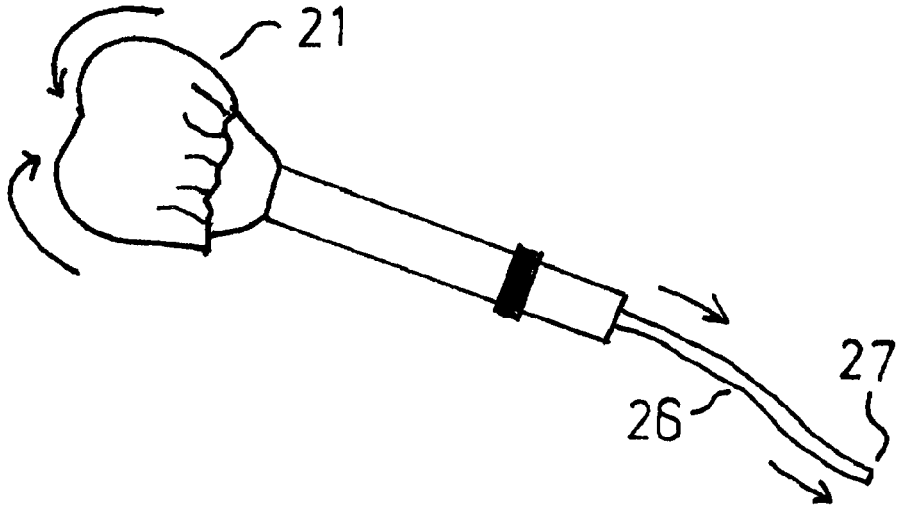
FIG. 16 is the disposable sheath from FIG. 15 being removed from the flexible head following use by pulling action being applied on the tether.

FIG. 16 is a perspective view of sheath 21 being moved from position two to position one as tether 26 is pulled out the end of hollow wand 31. After sheath 21 is turned completely outside in and is pulled from the end of hollow wand 31, it can be disposed of in a waste receptacle. Surface one of sheath 21 contacts the water and surface in the toilet bowl but never has to be touched by a user's hand. Sheath 21 can be tied at end 23 to contain any bad odors if desired. Following removal and disposal of used sheath 21, implement 30 is placed over storage tube 28 for storage until the next use, at which time open end 23 of the next sheath 21 extending above flexible head 32 of implement 30, is ready to be grasped and pulled up, out and over implement 30 again, moving the next sheath from position one to position two. This process is repeated for each sheath contained in storage tube 28.

Storage tube 28 in base 34 can be stored on the floor adjacent to the toilet so that the user does not have to go search for the disposable toilet bowl sheaths. If implement 30 positioned over storage tube 28 in base 34 is stored on the top of the toilet cistern, it is ready for immediate use by placing sheath 21 in position two and removing implement 30 from over the storage tube 28.

As one having ordinary skill in the art will readily ascertain and appreciate, the above described invention provides numerous advantages, including the provision of a multi-use implement comprising a head and wand that can be use with multiple disposable sheaths that: (1) substantially reduces the cost of materiel and distribution costs by separating the structural support provided by the head from the cleaning surface provided by the disposable sheath; (2) substantially conforms to the shape of the inside of a toilet bowl; (3) provides for easy placement and removal of the disposable sheath from the head without the user being required to touch any surface that has been in contact with the toilet bowl; (4) provides for easy disposal where any odors can be sealed inside a closed chamber before placement in the waste basket; (5) can be stored immediately adjacent to the toilet in a cartridge that holds multiple disposable sheaths; (6) can include a predetermined amount of cleaning composition that effectively cleans and disinfects a toilet surface; and (7) can be moved from the toilet bowl to the waste basket without dripping water on the floor.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

What is claimed is:

1. A device for cleaning a work surface comprising:

a.) a sheath having a first surface and a second surface, said sheath capable of assuming two positions, in a first position said first surface faces inward defining a first opening and a first chamber, and said second surface faces outward, and in a second position in which said first surface faces outward and said second surface defines a second opening and a second chamber;

b.) rough section on said first surface for cleaning a work surface as said sheath is in said second position;

c.) a tether element projecting from said second surface to facilitate moving said sheath from said second position to said first position;

wherein said sheath cooperates with an implement having a wand and a head, said head, affixed to said wand, having an exterior surface and an interior surface, said sheath assuming said second position with said head occupying said second chamber and said second surface abutting said exterior surface;

wherein said head has at least one interior surface defining a passage, said sheath received in said passage in said first position and assuming said second position as said second surface is drawn over in abutting relationship with said exterior surface of said head.

2. The device of claim 1 wherein said rough section is loaded with at least one chemical agent selected from the group consisting of cleaners, disinfectants, and sanitizers for effecting the task of cleaning the work surface.

3. The device of claim 2 further comprising seal means for closing said first chamber and wherein said chemical agent is stored with said first chamber closed with seal means.

4. The device of claim 3 wherein said seal means is selected from the group of closures comprising adhesive, interfitting flange and groove, and heat seal.

5. The device of claim 1 further comprising seal means for closing said first chamber and wherein said rough section is used with said sheath in said second position to clean a work surface, and upon completion of the cleaning task, said sheath is capable of being returned to said first position and said seal means sealed to contain any odors present in the first chamber.

6. The device of claim 1 wherein said tether element occupies said passage when said sheath is in said second position and capable of drawing said sheath into said first position in cooperation with said head as said tether element is withdrawn from said passage.

7. The device of claim 1 wherein said sheath is comprised of one or more materials selected from the group consisting of metal foils, polyfoils or plastic.

8. The device of claim 1 further comprising an implement.

9. A device for cleaning a work surface comprising:

a.) a sheath having a first surface and a second surface, said sheath capable of assuming two positions, in a first position said first surface faces inward defining a first opening and a first chamber, and said second surface faces outward, and a second position in which said first surface faces outward and said second surface defines a second opening and a second chamber;

b.) a rough section on said first surface for cleaning a work surface when said sheath is in said second position;

c.) an implement having a wand and a head wherein said head has an interior surface and an exterior surface, said interior surface defining a passage for receiving said sheath in said first position, said exterior surface for receiving said sheath in said second position.

10. The device of claim 9 further comprising a tether element projecting from said second surface to facilitate moving said sheath from said second position to said first position.

11. The device of claim 9 further comprising a storage tube and a base, said storage tube containing one or more sheaths, said base receiving said storage tube and supporting said storage tube in a vertical position, and said storage tube received in the passage of said head.

* * * * *